United States Patent [19]

Svoboda et al.

[11] Patent Number: 4,736,788

[45] Date of Patent: Apr. 12, 1988

[54] GATING APPARATUS

[75] Inventors: John M. Svoboda, Arlington Heights, Ill.; Raymond W. Monroe, Rochester Hills, Mich.

[73] Assignee: Casteel Technology Associates, Inc., DesPlaines, Ill.

[21] Appl. No.: 78,783

[22] Filed: Jul. 28, 1987

[51] Int. Cl.[4] ..... B22C 9/08

[52] U.S. Cl. ..... 164/363; 164/134; 164/138; 164/362; 249/109

[58] Field of Search ..... 164/363, 362, 134, 133, 164/138; 249/109

[56] References Cited

U.S. PATENT DOCUMENTS

| | | | |
|---|---|---|---|
| 2,459,025 | 1/1949 | Graham | 164/363 |
| 2,860,392 | 11/1958 | McCracken | 164/363 |
| 2,919,479 | 1/1960 | Menningen | 164/363 X |

FOREIGN PATENT DOCUMENTS

| | | | |
|---|---|---|---|
| 2159964 | 7/1972 | Fed. Rep. of Germany | 164/134 |
| 480487 | 6/1976 | U.S.S.R. | 164/134 |
| 856646 | 8/1981 | U.S.S.R. | 164/363 |

*Primary Examiner*—Nicholas P. Godici
*Assistant Examiner*—J. Reed Batten, Jr.
*Attorney, Agent, or Firm*—Irving Faber

[57] ABSTRACT

A bottom circular tray, a circular top cap and one or more circular disks are coupled thereto, the disks, the top cap and the bottom tray having a common central sprue or cylinder. The plurality of disks form an ascending spiral path from the bottom tray to the top cap. Liquid metal will flow through the central sprue to the bottom tray and up through the ascending spiral path to the top cap and into the mold cavity to form an inclusion free casting.

7 Claims, 3 Drawing Sheets

GATING APPARATUS

BACKGROUND OF INVENTION

A steel casting process uses the solidification of steel to form the rough shape of the final product. The liquid steel is poured into a prepared mold of the desired shape. The mold is normally made of silica sand held to shape by the use of a binder such as clay-water or a chemical reaction binder. The liquid metal is poured into an opening in the body of the mold and through a channel to the actual mold cavity. The channel system or the path in which the liquid metal flows to the mold cavity is called a gating system. In general, the liquid metal is poured from a holding vessel, normally loaded through the air into the gating system and into the mold easting cavity.

A major difficulty encountered in steel casting production is that metallic oxide particles are trapped in the steel product; said particles being called inclusions. These particles trapped in the product can cause difficulty in further processing of the casting such as machining and/or cause poor service performance. The inclusions, metallic oxide particles, can form because of a chemical reaction of the liquid metal with a source of oxygen such as air or because of physical entrapment of existing oxides by the liquid metal flow. Our gating system is designed to resist the erosive force of liquid metal flow and to trap the metallic oxide particles before the liquid metal enters the casting cavity.

Our improved gating system design combines floatation, centrifugal force and metal-inclusion-refractory surface chemistry to remove or trap metallic oxide inclusions prior to the introduction of metal into the casting mold cavity.

SUMMARY OF THE INVENTION

It is an object of our invention to provide an improved gating apparatus for a steel casting process that resists the erosive force of a liquid metal flow and to trap the metallic oxides before the liquid metal enters the casting cavity.

It is another object of our invention to provide an improved gating apparatus for a steel casting process wherein said gating apparatus is made independent from the mold, but is positioned in the mold so as to enable the liquid metal to flow through the gating system prior to entering the mold cavity where the casting is formed.

It is still another object of our invention to provide an improved gating apparatus wherein said gating apparatus eliminates or substantially reduces the amount of inclusions in a steel casting.

It is still another object of our invention to provide an improved gating apparatus wherein said apparatus comprises a bottom circular tray having coupled thereto a plurality of disks and a circular top cap; the disks and the tray having common apertures to form a cylinder when coupled together and said disks forming an upward spiral path; the circular top cap directing the metal flow into the mold cavity.

IN THE DRAWINGS

DETAILED DESCRIPTION OF THE PREFERRED EMBODIMENT

The present invention relates to a new and improved gating apparatus for steel castings and more particularly is directed to a gating apparatus that is made independent of a mold but is positioned in the mold to enable liquid metal to flow through the gating apparatus before entering the mold cavity.

Figure 1:
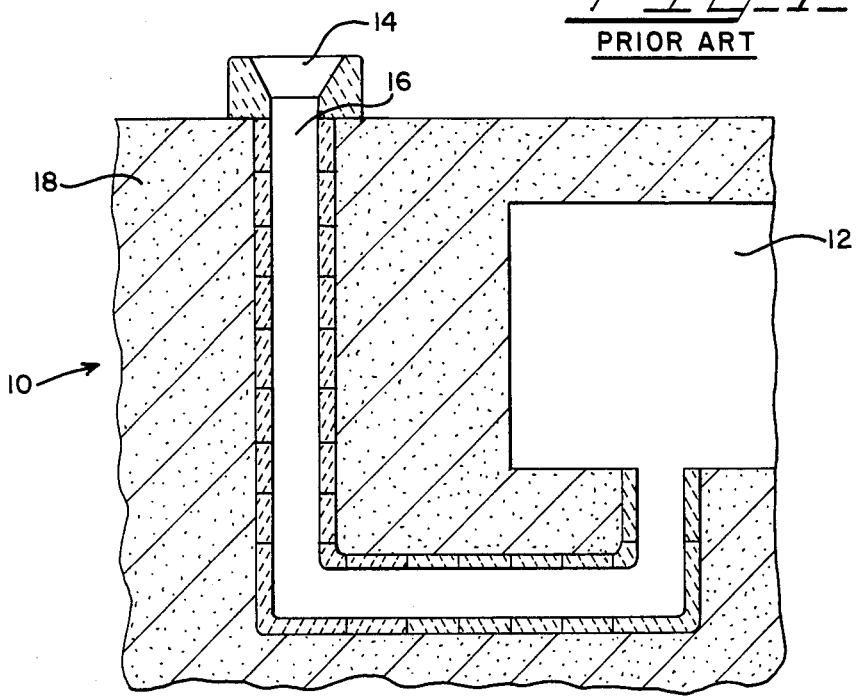
FIG. 1 PRIOR ART
FIG. 1 is a schematic drawing of a typical bottom gating apparatus currently used for casting steel.

FIG. 1 is a schematic drawing of a typical bottom gating apparatus currently used in the art for casting steel. The mold 10 is comprised of a mold cavity 12, a pouring cup 14, and a sprue 16. The liquid metal, not illustrated, is poured from a ladle or other similar type holding device, not illustrated, through the air into the pouring cup 14 of the mold 10. The liquid metal then flows through the sprue 16 into the mold cavity 12. The sprue 16 is lined with tile or core gate 17 between the pouring basin 14 and the mold cavity 12. The mold 10 is normally made of silica sand 18 held together by binders well-known in the art such as clay-water or a chemical reaction binder. This process for making steel castings produces undesirable metallic oxides or inclusions, not illustrated, before the liquid metal enters the cavity 12. The inclusions of the aforesaid process are eliminated or substantially reduced by our improved gating apparatus illustrated in FIGS. 2 through 7, which we will now discuss.

Figure 2:
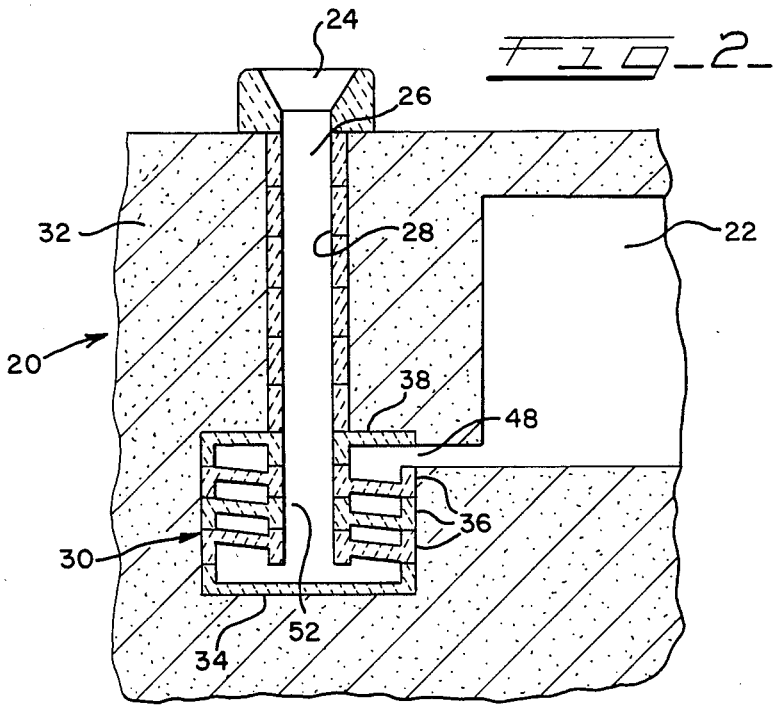
FIG. 2 is a schematic drawing of our improved gating apparatus positioned in a mold.
Figure 3:
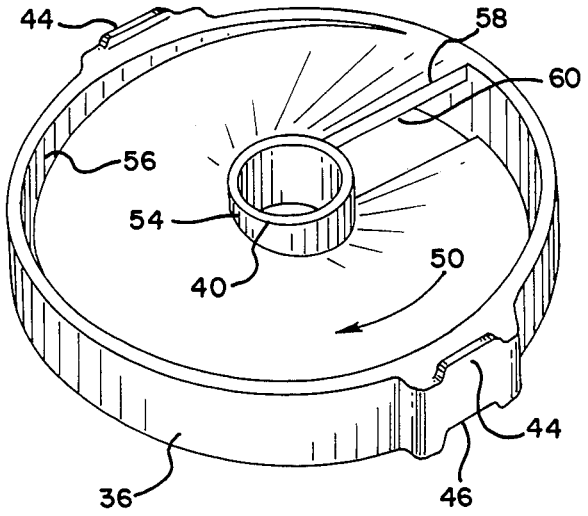
FIG. 3 is a perspective view of a single disk that forms part of the improved gating apparatus.
Figure 4:
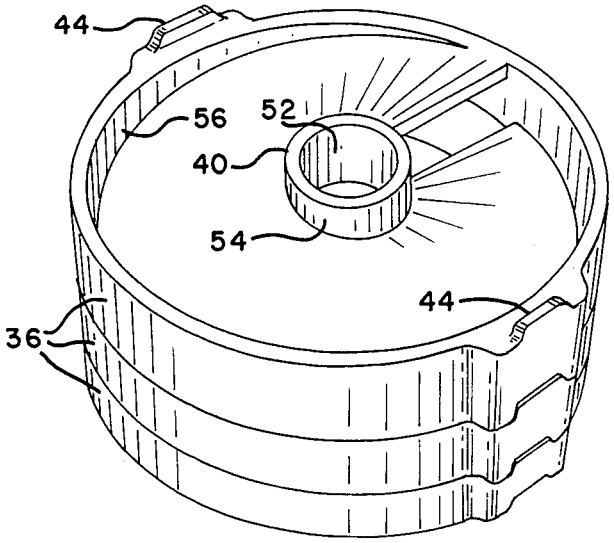
FIG. 4 is a perspective view of a plurality of disks of our improved gating apparatus.
Figure 5:
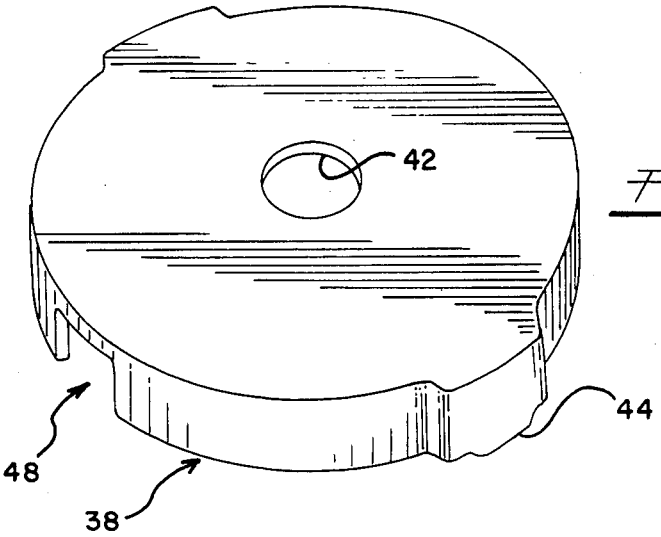
FIG. 5 is a top perspective view of the circular top cap that forms part of our improved gating apparatus.
Figure 6:
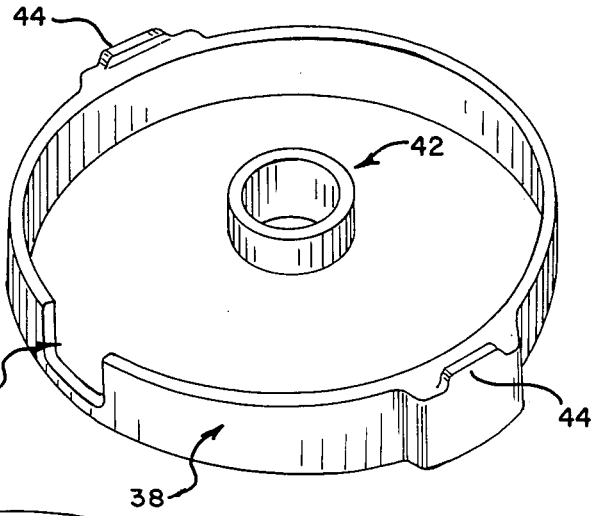
FIG. 6 is a bottom perspective view of the top cap of our improved gating apparatus.
Figure 7:
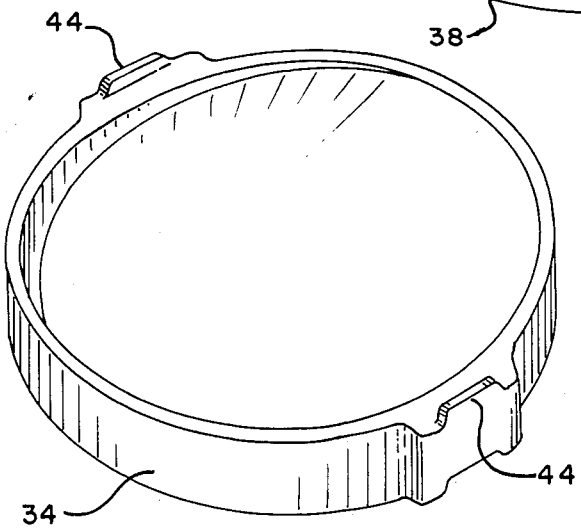
FIG. 7 is a perspective view of the bottom plate of our improved gating apparatus.

FIG. 2 is a schematic drawing of our improved gating apparatus comprising a mold 20 having a mold cavity 22, a pouring cup 24, a sprue 26 defined by tile or a core gate 28 and our gating system insert 30. The gating apparatus 30 is positioned in the mold 20 so as to enable liquid metal, not illustrated, to flow from the pouring cup 24, through the sprue 26 and gating system apparatus 30 into the mold cavity 22. Silica sand 32 with a binder well-known in the art forms the body of the mold 20. Our gating apparatus is comprised of a circular bottom plate 34, one or more disks 36 of the same diameter as the bottom plate 34 and a top cap 38. The disks 36 each have a collared aperture 40 and the top cap 38 has a collared aperture 42, each collared aperture is of the same diameter as the sprue 26. The bottom plate 34, each disk 36 and the top cap 38 have two or more flanges 44. The disks 36 each have two or more locking grooves 46 for receiving the flanges 44 so as to enable the bottom plate 34, the top cap 38 and the disks 36 to be stacked and locked into position. The top cap 38 has an ingate opening 48 having the same area as the sprue 26 that enables the liquid metal to flow into the mold cavity 22. The disks 36 each have their inner surface shaped in a partial spiral 50 thereby enabling the plurality of disks 36 to be stacked to provide a spiral path from the bottom plate 34 through the top cap 38 to the mold cavity 22. The collared apertures 40 and 42 of the plurality of stacked disks 36 and top cap 38 respectively form a sprue or cylinder 52 between the bottom plate 34 and the top cap 38, which is of the same diameter and concentric with the sprue 26.

In operation, our improved gating apparatus 30 uses both floatation and centrifugal force along with directed flow to bring inclusions, not illustrated, into a contact with the gating surface so that they are trapped therein. The flow of the liquid metal is down through a central sprue or cylinder 26, into the gating apparatus 30, through its cylinder 52, up the spiral path of the gating apparatus into the mold cavity 22. The liquid metal falls into the center of the bottom circular plate 34 via the cylinder 52 of the gating system insert 30, which dissipates the kinetic energy of free fall and allows the entrained air and/or inclusions in the liquid metal to float out. As the liquid metal continues to flow into the gating apparatus 30, the metal is pushed up an ascending spiral path formed by the partial spiral paths 50 of each disk 36. It is this upward path that provides a large surface of the gate to be in continuous contact with the ascending liquid metal stream including the inner and outer walls 54, 56 respectively of each disk and the upper and lower surfaces 58, 60 respectively of each disk. The ascending spiral of liquid metal permits the inclusions to contact the gating surfaces 54, 56, 58 and 60 and stick thereto. This removes the inclusions and prevents them from entering the casting cavity.

Our gating apparatus utilizes either a ceramic or core mixture to form the bottom plate 34, the disks 36, and the top cap 38. This has three advantages. One advantage is the use of a refractory aggregate or coating that will attract and retain inclusion material on the gate surface. A second advantage is the ability to use a complex flow system which will promote separation of inclusions from the flowing liquid metal. A third advantage is the consistency in design and manufacture as a separate item would be superior to the variability of existing methods.

The material of construction can be a refractory, fired or unfired, or a conventional bonded sand. This can be used coated or uncoated. Favorable surface energy effects result in the interaction of inclusions and the gating apparatus surface which enhance the entrapment of undesirable inclusions before they reach the mold cavity. For example, zircon, as a coating or aggregate, is known to enhance inclusion entrapment. The materials used are also selected to prevent erosion of the gating system material. For example, silicate-bonded core mixes are known to resist erosion.

Production of the gating apparatus, as a separate item, will allow better quality control and consistency. Since the flowing liquid metal stream is prone to cause the washing away of aggregate, the freedom of design and control in manufacture of the gating apparatus 30 can prevent this erosion and reduce inclusions.

The aforedescribed invention has been discussed relative to steel casting. However, it is understood that our improved gating apparatus can be used for casting of iron, aluminum, bronze etc.

It is further understood that the above described gating apparatus is simply illustrative of the application of principles of our invention and many other modifications, including the use of other refractory materials, may be made without departing from the spirit and scope of the invention.

We claim:

1. An improved gating apparatus for insertion into a steel casting mold having a mold cavity, a pouring cup and a sprue, said apparatus comprising:

a bottom circular plate;

a circular top cap having an ingate;

a plurality of disks each having a partial spiral path and coupled to the bottom circular plate and the top cap, said partial spiral paths forming a spiral path from the bottom plate to the top cap; and a collared aperture integral with each disk and the top cap, and being concentric therewith, the collared apertures of the plurality of disks and top cap forming a cylinder wherein liquid metal is introduced into the pouring cup of the mold and flows into the gating apparatus by means of the sprue, and into the mold cavity by means of the cylinder, the partial spiral paths of the disks and the ingate of the top cap; said gating apparatus removing inclusions prior to the liquid metal flowing into the mold cavity.

2. An improved gating apparatus as defined in claim 1 wherein said apparatus further comprises a plurality of flanges integral with the bottom circular plate, the top cap and the plurality of disks.

3. An improved gating apparatus as defined in claim 2 wherein said apparatus further comprises a plurality of grooves integral with each of the plurality of disks suitable for receiving the flanges of said disks, the bottom plate or the top cap, enabling a plurality of disks to be stacked and locked together.

4. An improved gating system as defined in claim 3 wherein the collared apertures of each disk and the top cap are concentric and form a cylinder.

5. An improved gating system as defined in claim 4 further comprising a spiral path for the flow of liquid metal, said spiral path being defined by stacking concentrically the plurality of disks, said spiral path commencing at the bottom circular plate and terminating at the ingate of the top cap.

6. An improved gating apparatus as defined in claim 5 wherein the disks, the top cap and the bottom circular plate are formed of a ceramic mixture suitable for receiving a refractory aggregate coating to attract and retain inclusions from the liquid metal prior to said metal flowing into the mold cavity.

7. An improved gating apparatus as defined in claim 6 wherein said refractory coating is zircon.

* * * * *